US007111326B1

(12) United States Patent
Sullivano et al.

(10) Patent No.: US 7,111,326 B1
(45) Date of Patent: Sep. 26, 2006

(54) BALL GLOVE HAVING OPENINGS AND IMPROVED WEIGHT BALANCE

(75) Inventors: Brian A. Sullivano, Geneva, IL (US); Shigeaki Aso, Hoffman Estates, IL (US); Patrick Udelhofen, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 11/216,798

(22) Filed: Aug. 31, 2005

(51) Int. Cl.
*A63B 71/14* (2006.01)

(52) U.S. Cl. ..... 2/19; 2/159; 2/161.1; 2/161.2; 2/161.3; 2/161.4; 2/161.5; 2/161.6; 2/162; 2/163; 2/167; 2/169; 2/16; 2/20; 2/160; 473/205

(58) Field of Classification Search ..... 2/19, 2/159, 161.1, 161.2, 161.3, 161.4, 161.6, 2/162, 163, 167, 169, 16, 20
See application file for complete search history.

(56) References Cited

U.S. PATENT DOCUMENTS 1,045,231 A * 11/1912 Whitley ..... 2/19
3,528,107 A * 9/1970 Rosenbaum ..... 2/19
4,195,365 A * 4/1980 Eyman et al. ..... 441/57
4,896,376 A 1/1990 Miner ..... 2/19
5,402,537 A 4/1995 Kolada ..... 2/19
5,572,739 A 11/1996 Kolada et al. ..... 2/19
5,829,061 A * 11/1998 Visgil et al. ..... 2/161.6
6,681,402 B1 1/2004 Bevier et al. ..... 2/19
6,766,531 B1 * 7/2004 Sullivano et al. ..... 2/19
2005/0268366 A1 * 12/2005 Anderson ..... 2/19

* cited by examiner

*Primary Examiner*—Gary L. Welch
*Assistant Examiner*—Alissa J. Tompkins
(74) *Attorney, Agent, or Firm*—Terence P. O'Brien

(57) ABSTRACT

A ball glove including a front glove portion, a back glove portion and a webbing. The back glove portion is coupled to the front glove portion to define a hand cavity and to form first, second, third and fourth finger stalls and a thumb stall. Each finger stall includes a distal region and a proximal region. At least one through-stall opening is formed into the distal region of at least one of the finger stalls. The through-stall opening having a size of at least 0.25 square inches. The webbing is coupled to, and positioned between, the first finger stall and the thumb stall.

65 Claims, 16 Drawing Sheets

BALL GLOVE HAVING OPENINGS AND IMPROVED WEIGHT BALANCE

FIELD OF THE INVENTION

The present invention relates generally to a ball glove for baseball, softball and other sports. In particular, the present invention relates to a ball glove having a plurality of openings and a corresponding reduced weight.

BACKGROUND OF THE INVENTION

Ball gloves for use in baseball, softball and other sports are well known. Ball gloves typically include a front panel connected to a corresponding back panel to form a hand cavity. The front and back panels typically generally resemble the shape of a human hand and when assembled form five stalls for receiving the thumb and fingers of a user's hand. The front and back panels form a hand opening at the lower edge of the glove. A webbing is typically connected between the thumb stall and the index finger stall of the ball glove. Ball gloves also typically include a hand opening for enabling a user to insert his or her hand into the hand cavity of the ball glove, and, often, an index finger hole for enabling the user's index finger to rest on the back portion of the index finger stall during use. Many existing ball gloves are formed of high quality, relatively expensive materials, such as natural leather, synthetic leather, and combinations thereof.

Ball gloves are generally constructed of highly durable materials to withstand the repeated impact of fielded balls during play and the scrapes and other contact with the playing field and other objects during play. Also, ball gloves are generally sized to be much larger than the hand of the ball player. The increased size is desirable in that it provides a larger pocket, or catching area for receiving a ball during play, enabling a player to reach more balls in play than would otherwise be possible with a glove matching the size of a player's hand. The size of a ball glove also typically varies by position. An outfielder's ball glove is typically larger than infielder's ball glove, and a first baseman's ball glove is typically larger than an outfielder's glove.

Existing ball gloves however have some drawbacks. The size and construction of existing ball gloves result in ball gloves having a weight, which typically falls within the range of 8 to 30 ounces. Further, a large percentage of the weight of such gloves exists in the elongate finger and thumb stalls, which tends to distribute the ball glove's weight away from the ball player's hand toward the outer regions of the ball glove. This weight distribution with increased weight at the outer regions of the ball glove increases the moment of inertia of the ball glove making the ball glove more difficult to quickly maneuver and manipulate during play. The weight, and weight distribution, of a ball glove can also induce fatigue, particular for younger players, or in player's involved in extended games or double-headers. The increased weight of a ball glove can also contribute to neck or back strain.

Moreover, such ball gloves with enlarged and extended finger and thumb stalls can inhibit or obstruct a ball player's view when attempting to field a ball, particularly fly-balls and pop-ups. When fielding fly-balls and pop-ups, it is customary for a ball player to position the ball glove between his or her upper body (including his or her head) and the ball. While in this position, the ball player must carefully position the large ball glove to avoid obstructing the player's view of the ball. Unfortunately, it is not uncommon for the player's ball glove to obstruct his or her view of the ball contributing to a missed ball, or, at a minimum, increasing the difficulty of the catch.

Thus, there is a continuing need for a ball glove that is properly sized for the player's position without having excessive weight and without producing a weight imbalance. What is needed is a properly sized ball glove that does not unnecessarily induce player fatigue or reduce the maneuverability of the ball glove. It would be advantageous to provide a ball glove that is properly sized without unnecessarily obstructing a player's view of a ball during play. It would also be advantageous to provide such a ball glove without substantially increasing the cost or complexity of the glove.

SUMMARY OF THE INVENTION

The present invention provides a ball glove including a front glove portion, a back glove portion and a webbing. The back glove portion is coupled to the front glove portion to define a hand cavity and to form first, second, third and fourth finger stalls and a thumb stall. Each finger stall includes a distal region and a proximal region. At least one through-stall opening is formed into the distal region of at least one of the finger stalls. The through-stall opening having a size of at least 0.25 square inches. The webbing is coupled to, and positioned between, the first finger stall and the thumb stall.

According to a principal aspect of a preferred form of the invention, a ball glove for use by a ball player in catching a ball includes a front glove portion, a back glove portion and a webbing. The back glove portion is coupled to the front glove portion to define a hand cavity and to form first, second, third and fourth finger stalls and a thumb stall. Each finger stall includes a distal region and a proximal region. At least one through-stall opening is formed into at least one of the finger stalls. The through-stall opening is sufficiently sized to enable the ball player to see the ball through the opening. The webbing is coupled to, and positioned between, the first finger stall and the thumb stall.

According to a another principal aspect of a preferred form of the invention, a ball glove includes a front glove portion, a back glove portion and a webbing. The back glove portion is coupled to the front glove portion to define a hand cavity and to form first, second, third and fourth finger stalls and a thumb stall. Each of the finger stalls and thumb stall define an elongate opening. At least one through-stall opening formed into at least one of the finger stalls. One or more of the through-stall opening are un-laced. The webbing is coupled to, and positioned between, the first finger stall and the thumb stall.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
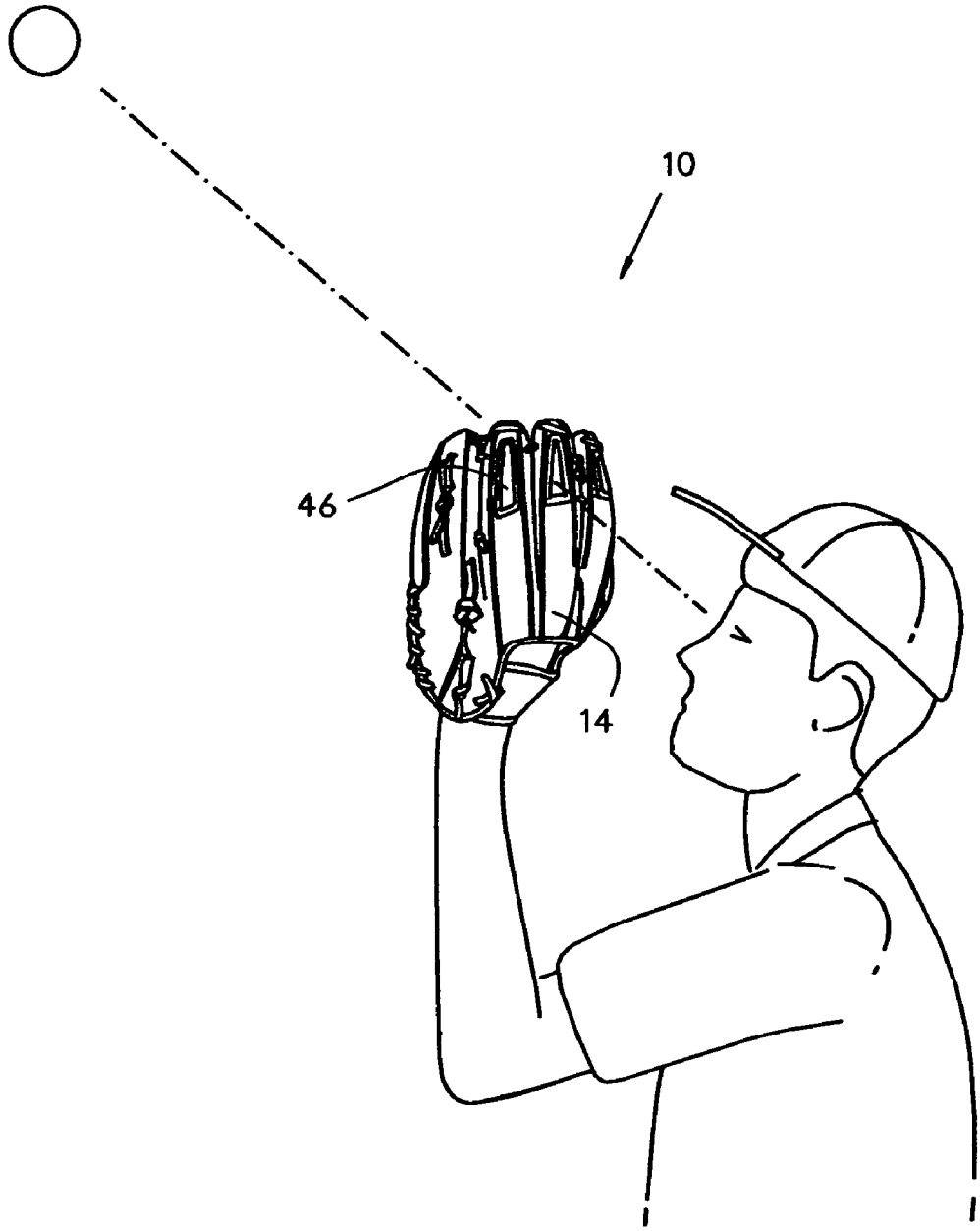
FIG. 1 is a side view of a ball glove in use in accordance with a preferred embodiment of the present invention.
Figure 2:
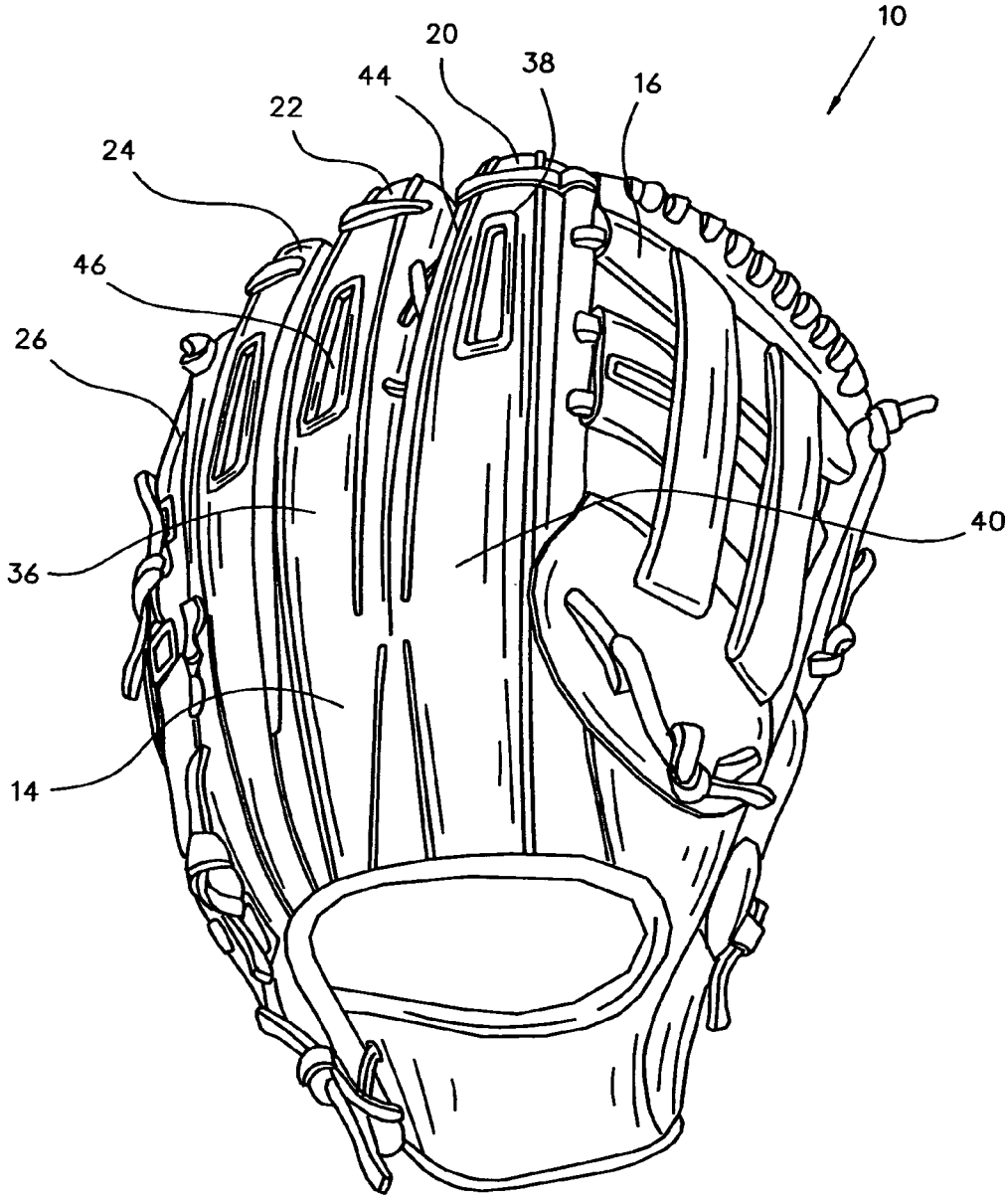
FIG. 2 is a rear view of the ball glove of FIG. 1.
Figure 3:
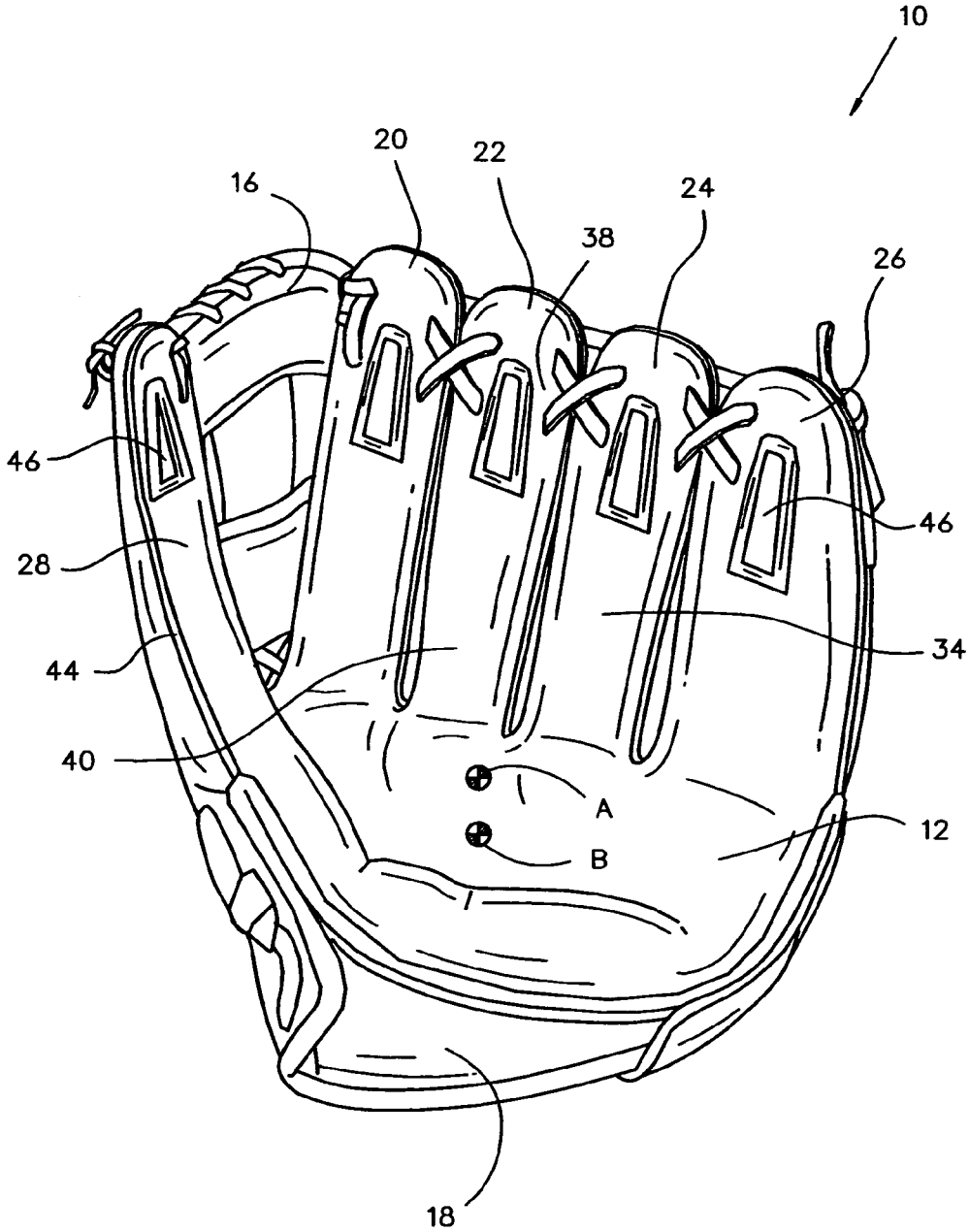
FIG. 3 is a front palm view of the ball glove of FIG. 1.

Referring to FIGS. 1 through 3, a ball glove is indicated generally at 10. The ball glove 10 is configured for use in baseball, softball, hockey and other sports involving ball gloves. The ball glove 10 can also be referred to as a mitt. The present invention is directly applicable to any ball glove or ball mitt including, for example, a first baseman mitt and a catcher's mitt. The ball glove 10 includes a front glove portion 12, a back glove portion 14 and a webbing 16.

The front and back portions 12 and 14 are contoured sheet-like structures, each generally resembling a hand. The front and back portions 12 and 14 are connected together to define a hand cavity 18, and to form first, second, third and fourth finger stalls 20, 22, 24, 26, and a thumb stall 28. Each finger and thumb stall 20–28 defines an elongate cavity for receiving the respective finger or thumb of the user. The front and back portions 12 and 14 are preferably stitched together. In one preferred embodiment, the front and back portions 12 and 14 are coupled together through the use of weltings. Alternatively, the front and back portions 12 and 14 can be connected through other means, such as, for example, lacings, bonding, molding or adhesives and combinations thereof. The front portion 12 covers and protects the palm-side of the user's hand from impact with the ball. The back portion 14 supports the front portion 12 and protects the backside of the user's hand. The front and back portions 12 and 14 are made of a pliable, durable, and relatively soft material, preferably leather. In alternative preferred embodiments, the front and back portions 12 and 14 can be made of other materials, such as, for example, artificial leather, composite leather, rubber, plastic, other polymers and combinations thereof.

The webbing 16 is a generally flat structure that is connected, and preferably stitched and/or laced, to the front and back portions 12 and 14 between the first finger stall 20 and the thumb stall 28. The webbing 16 provides a region for facilitating catching and/or securing of a ball during play.

The finger stalls 20–26 and the thumb stall 28 are elongate cavities adapted for receiving the fingers and thumb of the user. Each finger stall 20–26 and thumb stall 28 includes a front stall portion 34 of the front portion 12 and a back stall portion 36 of the rear portion 14. Each finger stall 20–26 and thumb stall 28 also includes a distal region 38 and a proximal region 40. The front and back stall portions 34 and 36 are coupled to each other, preferably through a plurality of weltings 44, lacings and stitchings. Alternatively, the front and back stall portions 34 and 36 can be connected through other means, such as, for example, stitching only, bonding, other fasteners or molding. In order to facilitate the fielding of balls during play, the ball glove 10 is typically larger than the hand of the user. In particular, the finger and thumb stalls 20–28 are typically significantly longer than the length needed to accommodate the user's fingers and thumb.

At least one stall opening 46 is formed into at least one of the finger and thumb stalls 20–28. In one embodiment, as shown in FIGS. 1–3, each opening 46 is a through-stall opening such that light and/or objects can pass through the opening 46. Alternatively, the openings can be formed to extend only through a portion of the stall. Preferably, at least one through-stall opening 46 is formed into the distal portion 38 of each of the finger and thumb stalls 20–28. In alternative preferred embodiments, the openings can be formed in two, three or four of the finger and thumb stalls, can include two or more openings on a single stall, and the openings can be formed at any location about or along the finger and thumb stalls.

Referring to FIG. 1, the through-stall openings 46 are sufficiently sized to enable a ball player to see through the openings 46 while wearing the ball glove 10. For example, a player may view a ball through one or more of the through-stall openings 46, thereby facilitating the ball player's ability to field a ball during play. The through-stall openings 46 reduce or eliminate any obstructed view created by conventional finger and/or thumb stalls having no through-stall openings. The through-stall openings 46 can also facilitate an umpire's ability to see a fielded ball within the ball glove 10. In order for an umpire to complete a call on a play involving the tagging of a baserunner or the fielding of a fly-ball, the umpire must ensure that the fielder has caught and retains possession of the ball while tagging runner and/or fielding the ball. In many instances it can be difficult for an umpire make that determination because the ball glove can obstruct the umpire's view of the front or palm side of the ball glove. The through-stall openings will facilitate an umpire's ability to confirm that the ball is within the player's ball glove and make such a call quickly and accurately.

Figure 4:
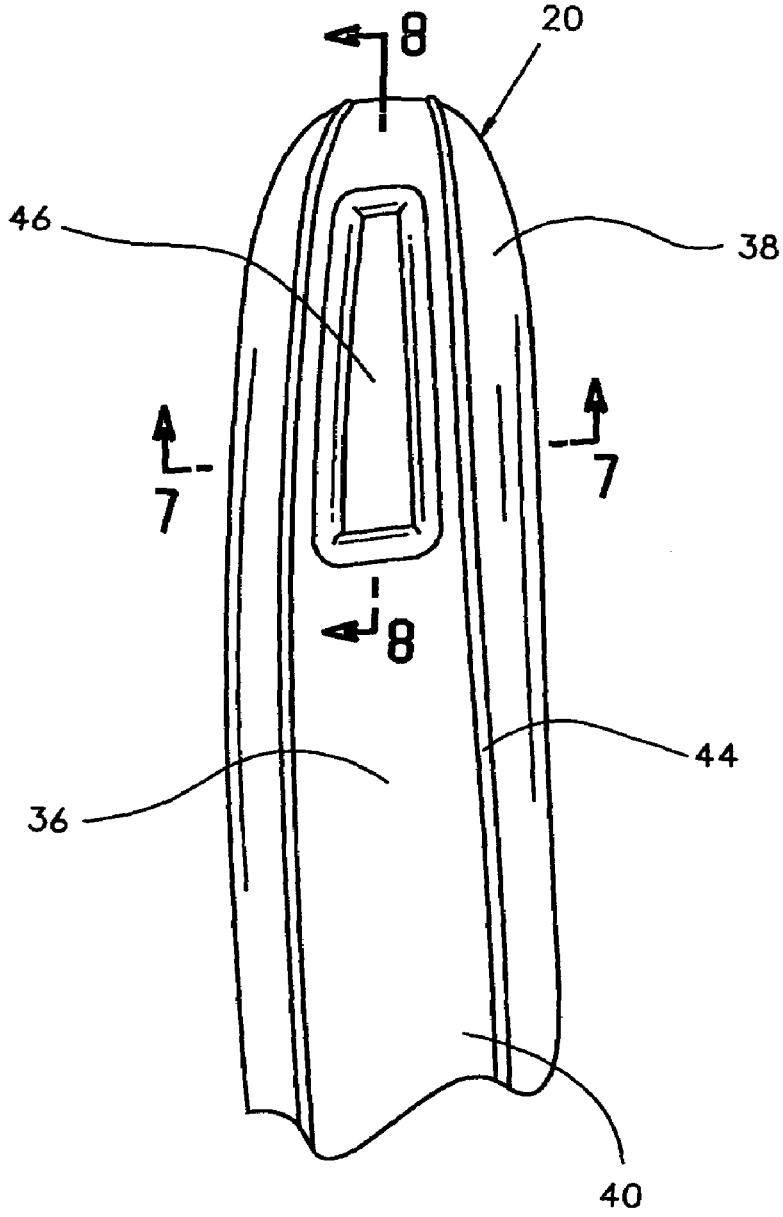
FIG. 4 is a rear view of one of the finger stalls of the ball glove of FIG. 1.

Referring to FIGS. 2–4, in one preferred embodiment each of the through-stall openings 46 is sized to be at least 0.25 $in^2$. In another alternative preferred embodiment the through-stall openings 46 can be sized to be at least 0.50 $in^2$. In other alternative preferred embodiments, each through-stall opening can be sized to be at least 0.75 $in^2$, 1.0 $in^2$, 1.25 $in^2$ and 1.5 $in^2$. In yet other alternative embodiments, the through-stall openings can vary size from one location to the next on the ball glove. In another alternative preferred embodiment, one or more through-stall openings 46 sized less than at least 0.25 $in^2$ can be used. For example, three or more small through-stall openings can be formed into a single stall to form part or all of a particular pattern or appearance on the ball glove. The total area of the plurality of small through-stall openings can be at least 0.25 $in^2$. The through-stall openings 46 are preferably un-laced meaning that a lacing or lace segment does not extend through opening from one side of the finger or thumb stall to the other side.

Referring to FIG. 3, the material removed from the finger and thumb stalls 20–28 to define the through-stall openings 46, reduces the overall weight of the ball glove. More importantly, the removed material reduces the weight of the outer regions of the ball glove, which advantageously lowers the moment of inertia of the ball glove and repositions the center of gravity of the ball glove closer to the users palm and wrist. By reducing the weight of the ball glove at it's outer regions, the ball glove can become significantly more maneuverable, enabling ball players to potentially reach or field more balls during play, including sharply hit balls requiring quick reaction time. A ball glove having a high moment of inertia and a high center of gravity can be considered relatively "top-heavy" and can be difficult to quickly turn, reposition or move. As a result, a player may not be able to properly field some sharply hit balls.

Generally speaking, infielders select ball gloves that are smaller in size than outfielders. Infielders prefer the smaller ball gloves because such gloves are lighter, have a lower moment of inertia, and therefore are easier to maneuver. An outfielder is not as close to the plate and therefore has more time to adjust his or her body and glove to field a ball. The larger ball glove used by outfielders enables them to reach more balls than would otherwise be possible with a smaller glove. The present invention can be employed to enable an infielder to also select a larger ball glove because a larger ball glove that incorporates the present invention can have a moment of inertia that is comparable or the same as a small ball glove without the through-stall openings. Accordingly, a larger ball glove incorporating the present invention can provide the same or comparable maneuverability as a smaller ball glove. Therefore, the present invention can enable an infielder to possess a highly maneuverable ball glove that is larger in size and capable of reaching more balls.

Points A and B correspond to the center of gravity, or balance point, of the ball glove without and with the through-stall openings 46 formed into the ball glove 10. Point A represents the location of the center of gravity of the ball glove when the through-stall openings are not formed into the ball glove, and point B represents the location of the center of gravity of the ball glove with the through-stall openings 46. The shift of the center of gravity or balance point of the ball glove essentially reduces the moment or "lever-arm" required by the user to turn the ball glove. At point B, the center of gravity is closer to the player's wrist and therefore the ball glove feels lighter and is easier to maneuver than a ball glove with a higher center of gravity, such as point A. Thus, the present invention results in a ball glove having an improved weight distribution or balance by advantageously shifting the center of gravity of the ball glove closer to the user's wrist.

Further, the present invention may allow for a player to play with a slightly larger ball glove without having the negative consequences of added weight and/or reduced maneuverability. Therefore, with the present invention, an infielder may opt for slightly larger ball glove without negatively affecting his or her quickness of play. A larger ball glove with the improved weight balance can allow a player to reach more balls than with a conventional smaller ball glove.

Figure 5:
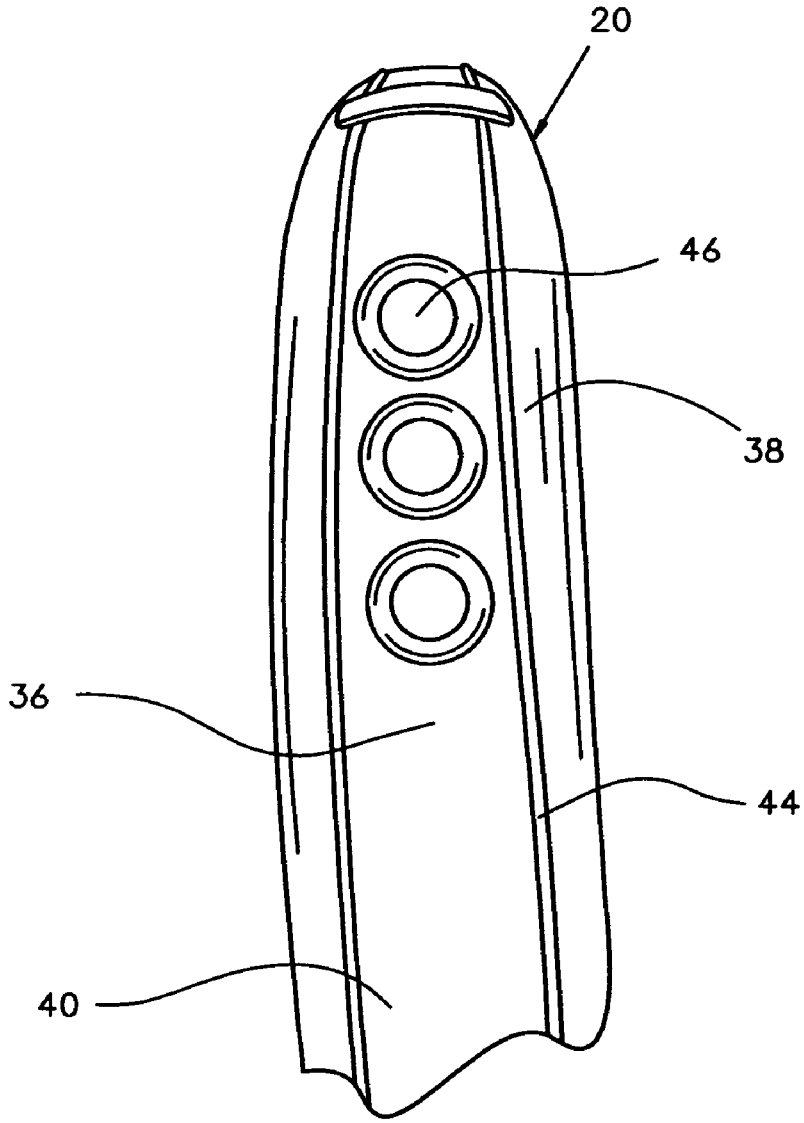
FIG. 5 is a rear view of a finger stall of a ball glove in accordance with an alternative preferred embodiment of the present invention.
Figure 6:
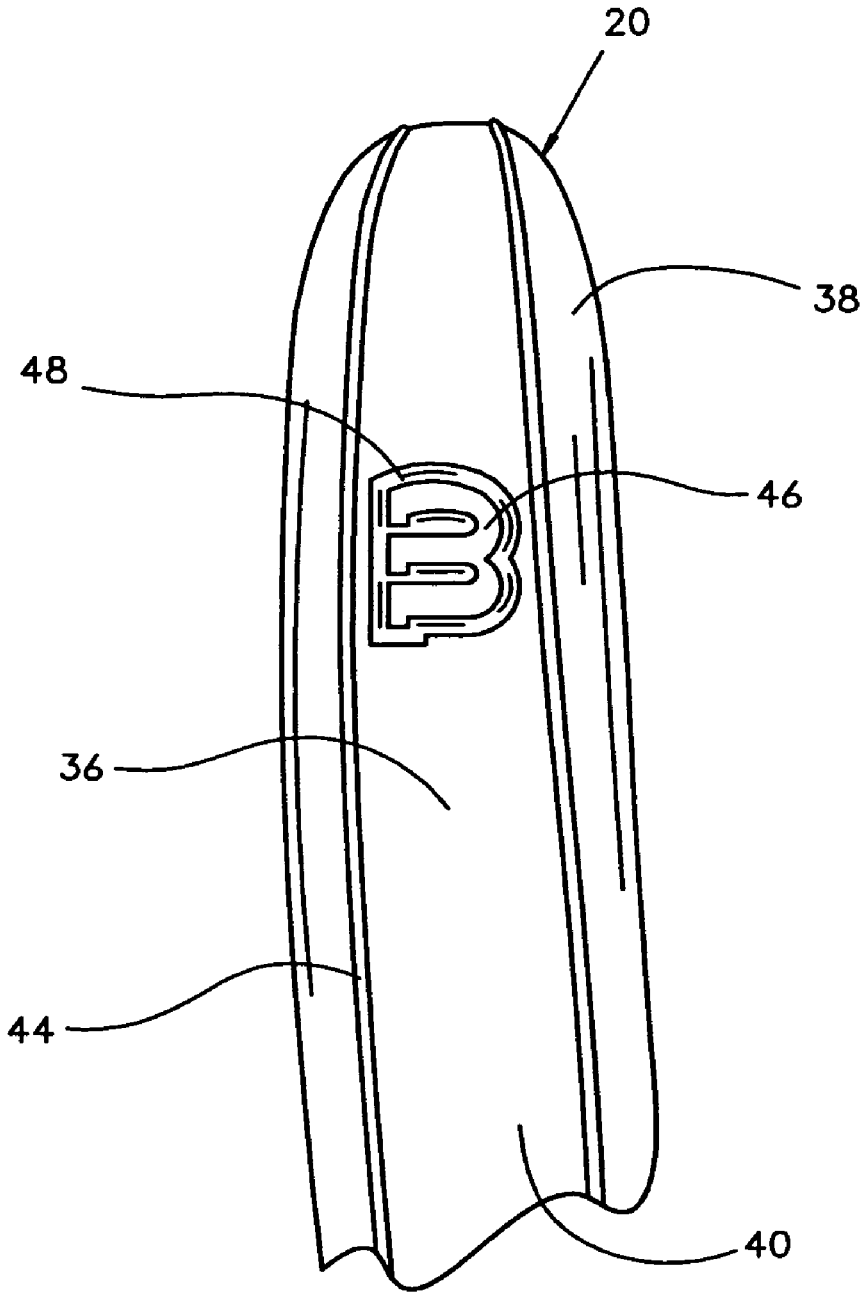
FIG. 6 is a rear view of a finger stall of a ball glove in accordance with another alternative preferred embodiment of the present invention.

Referring to FIGS. 4–6, three different preferred embodiments for the shape of the through-stall openings 46 are shown. In one preferred embodiment, as shown in FIG. 4, the opening of the through-stall opening has a generally trapezoidal shape. In additional alternative preferred embodiments, the through-stall opening can be formed in a shape that is circular (see FIG. 5), triangular, rectangular, polygonal, any closed-curved shape, irregular, and combinations thereof. Further, more than one shape for the through-stall opening can be used on the ball glove. In another alternative preferred embodiment, as shown in FIG. 6, the through-stall opening can be formed in the shape of a trademark 48 (such as the W® of Wilson Sporting Goods Co.). Alternatively, the through-stall opening can be formed into the shape of any alpha-numeric character, symbol, logo and combinations thereof. As shown in FIG. 5, a single or multiple through-stall openings 46 can be used on a single finger stall 20.

Figure 7:
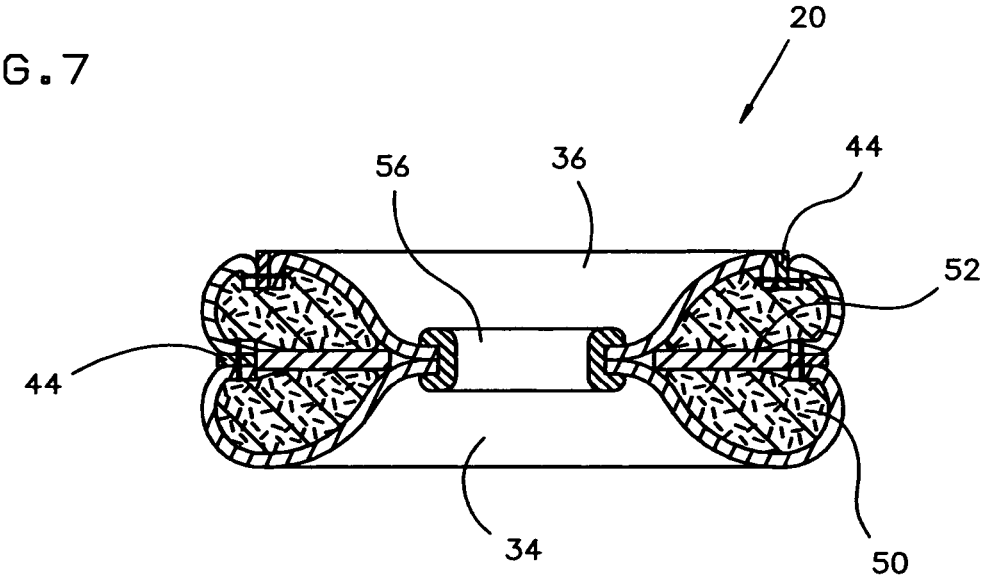
FIG. 7 is a transverse cross-sectional view of the finger stall taken along line 7—7 of FIG. 4.
Figure 8:
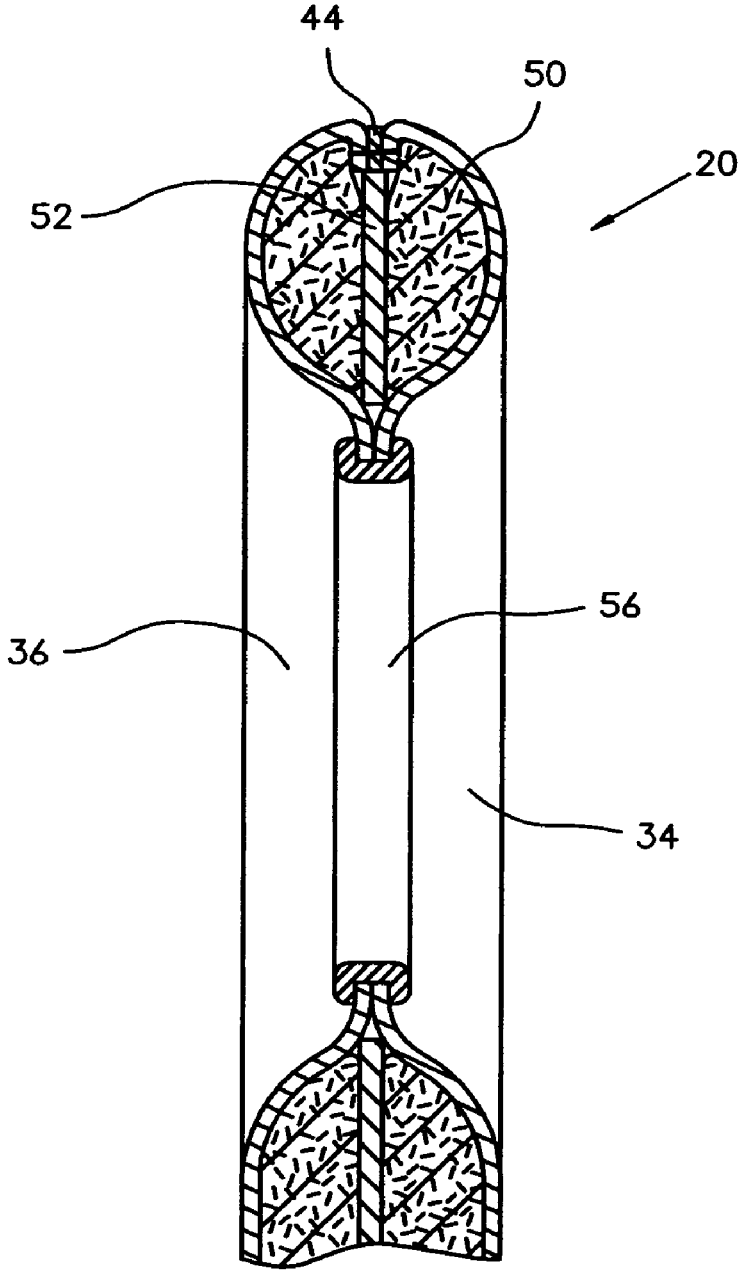
FIG. 8 is a longitudinal cross-sectional view of the finger stall taken along line 8—8 of FIG. 4.

Referring to FIGS. 4, 7 and 8, the through-stall opening 46 of one of the finger stalls 20 is shown in greater detail. The front and back stall portions 34 and 36 are coupled to each other, preferably through the weltings 44 and stitching to form the finger and thumb stalls (finger stall 20 is shown as an example). Additional weltings 44 can also be used to stiffen the finger stall 20 and to improve the appearance of the ball glove. Each weltings 44 is an elongate bar of durable material, preferably leather, that is stitched to one or more pieces of the ball glove, such as the front and back stall portions 34 and 36. Alternatively, the welting can be formed of any material that is capable of being stitched, such as, for example, synthetic leather, polymeric materials, rubbers, and combinations thereof. In other embodiments, the weltings 44 can be coupled to the finger liner through adhesives. The weltings can be formed of one or more colors or textures, and the ball glove 10 can include weltings of various colors or textures. Preferably, the material of each welting has a higher stiffness, and preferably a higher hardness, than the material of the finger and thumb stalls 20–28.

The finger stall 22 also includes one or more layers of padding 50 and one or more lining members 52. The padding 50 is positioned within the finger stall 20 to protect the player's hand from impact with the ball. At the distal region 38 of the finger stall 20, the padding 50 contributes to the desired generally tubular shape of the finger stall 20. The lining member 52 longitudinally extends through the finger stall 20 and can be used to stiffen and/or strengthen the finger stall, thereby contributing to make the finger stall more resistant to rearward bending upon impact with a ball during use. The welting 44, padding 50 and lining member 52 can all contribute to stiffen or maintain the structural integrity of the finger stall 20 having an opening 46 defined in it.

The front and back stall portions 34 and 36 are drawn together at the distal region 38 of the finger stall 20, and are preferably stitched together at the opening edges 54 (shown in FIG. 9), to form the through-stall opening 46. The drawing together of the front and back stall portions 34 and 36 provides a unique tapered shape to the finger stall 20 adjacent to the opening 46. To form the opening 46, an amount of material (which can include the front and back stall portions 34 and 36 and the padding 50), generally sized to match the desired size of the through-stall opening, is removed from the distal region 38 of the finger stall 20. This material can be punched, cut, stamped, or otherwise removed, from the finger stall 20 to form the through-stall opening 46. In other alternative preferred embodiments, the through-stall opening can be formed into the finger stall through molding, forming or other conventional methods.

In a preferred embodiment, the finger stall 20 further includes a binding 56 extending about opening edges 54. The binding 56 generally wraps around and covers the edges 54 of the front and back stall portions 34 and 36 at the through-wall opening. The binding 56 is stitched to one or more pieces of the ball glove, such as the front and back stall portions 34 and 36. Alternatively, the binding can be coupled to the front and back stall portions through adhesives, stapling or other conventional fastening means. The binding 56 is preferably formed of a generally flexible, durable material, such as leather. Alternatively, the binding 56 can be formed of other materials, such as, for example, synthetic leather, plastic, other polymeric materials, composite materials, rubber, and combinations thereof. The binding 56 can be formed of one or more colors or textures, which can match or differ from the color and texture of the front and back stall portions 34 and 36. The binding 56 can also be formed to be stiffer and/or harder than the material forming the front and back stall portions to further strengthen or stiffen the distal region 38 of the finger stall 20. The binding can be formed of one or more pieces or layers. The through-stall openings 46 provide the ball glove 10 with a unique, aesthetically pleasing appearance.

Figure 9:
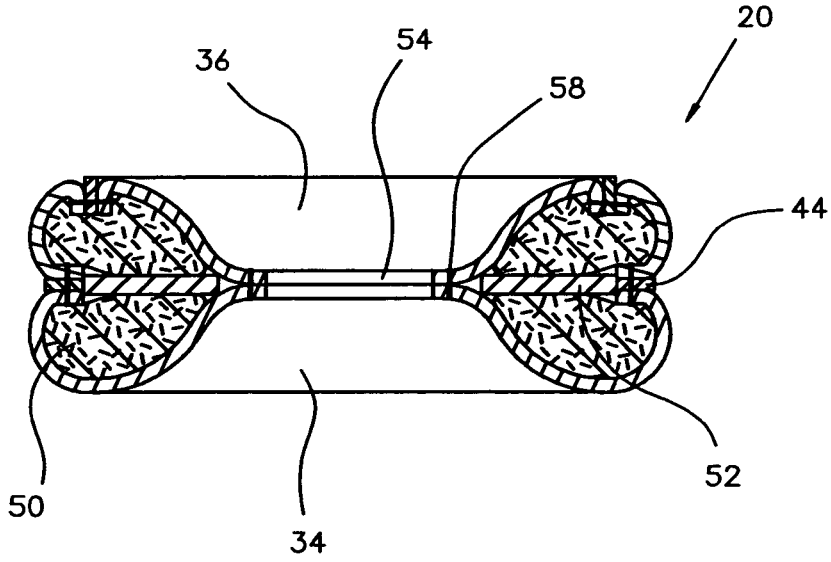
FIG. 9 is a transverse cross-section view of a finger stall a ball glove in accordance with another alternative preferred embodiment of the present invention.

Referring to FIG. 9, in an alternative preferred embodiment, the through-stall opening 46 of the finger stall 20 can be formed without the use of the binding 54 wrapping about the opening edges 54. In this preferred embodiment, the opening edges 54 of the front and back stall portions 34 are 36 are visible including the stitching 58, also providing the ball glove with a unique tapered shape at the finger stall 20 adjacent to the opening 46.

Figure 10:
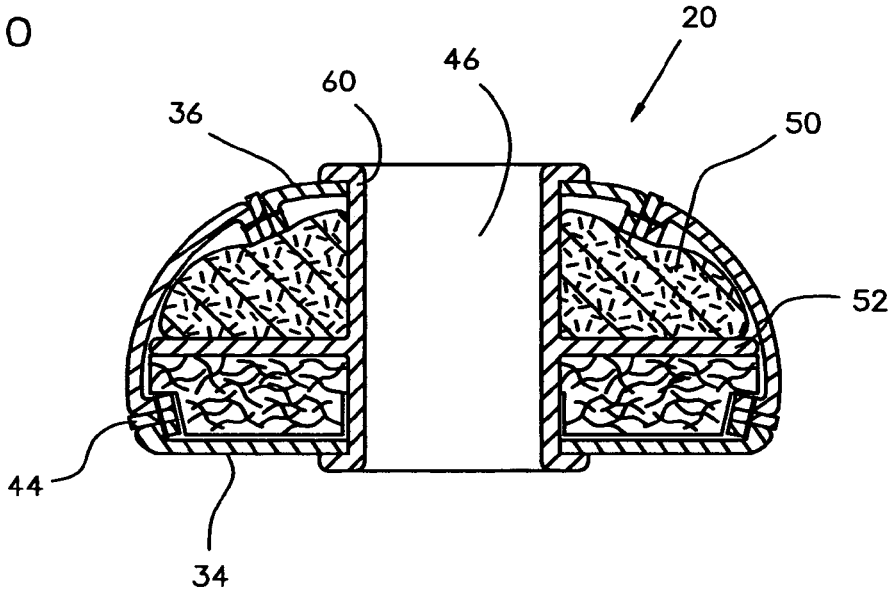
FIG. 10 is a transverse cross-sectional view of a finger stall a ball glove in accordance with another alternative preferred embodiment of the present invention.

Referring to FIG. 10, another alternative preferred embodiment of the through-stall opening 46 of one of the finger stalls (finger stall 20) is shown. The finger stall opening 46 can be formed and shaped using a stall insert 60. The stall insert 60 extends through the distal region 38 of the finger stall 20 and defines the shape of the through-stall opening 46. Unlike the embodiments of FIGS. 7–9, the front and back stall portions 34 and 36 can remain spaced apart by a predetermined amount. In one particularly, preferred embodiment as shown in FIG. 10, the front and rear stall portions 34 and 36 generally follow the contour of a conventional finger stall of a ball glove without being drawn closer to each other at the through-stall opening 46. Alternatively, the stall insert 60 can be used to partially draw in or fully draw in the front and back stall portions thereby providing a large variety of different contours to the ball glove adjacent the through-stall opening. In one preferred embodiment, the stall insert spaces the front and back stall portions by a distance within the range of 0.25 to 2.0 inches. In another preferred embodiment, the stall insert spaces apart the front and back stall portions by a distance within the range of 0.5 to 1.5 inches.

The stall insert 60 is preferably formed of a lightweight, durable material, such as a plastic. Alternatively, the stall insert 60 can be formed of other materials, such as, for example, composite materials, wood, metal, leather, synthetic leather, other polymeric materials, rubber, and combinations thereof. The stall insert 60 is preferably affixed to the front and back stall portions 34 and 36. Alternatively, the stall insert 60 can be coupled to the front and back stall portions 34 and 36 through other conventional fastening means, such as, for example, stitching, thermal bonding, adhesives, stapling and combinations thereof. The stall insert 60 can be formed of one or more colors or textures, which can match or differ from the color and texture of the front and back stall portions 34 and 36. The stall insert 60 can also be formed to be stiffer and/or harder than the material forming the front and back stall portions to further strengthen or stiffen the distal region 38 of the finger stall 20. The stall insert 60 can be formed of an assembly of one or more pieces or layers. The stall insert 60 can be pre-formed to define the desired shape of the through-stall opening 46.

The stall insert 60 can partially over lap the front and back stall portions 34 and 36. Alternatively, the stall insert can be coupled to the front and back stall portions such that at least a portion of the front and/or back stall portion overlap the stall insert, or such that no overlapping occurs between the stall portions and the stall insert. The stall insert 60 can be installed at other locations about the finger stall or about the ball glove, in general.

Figure 11:
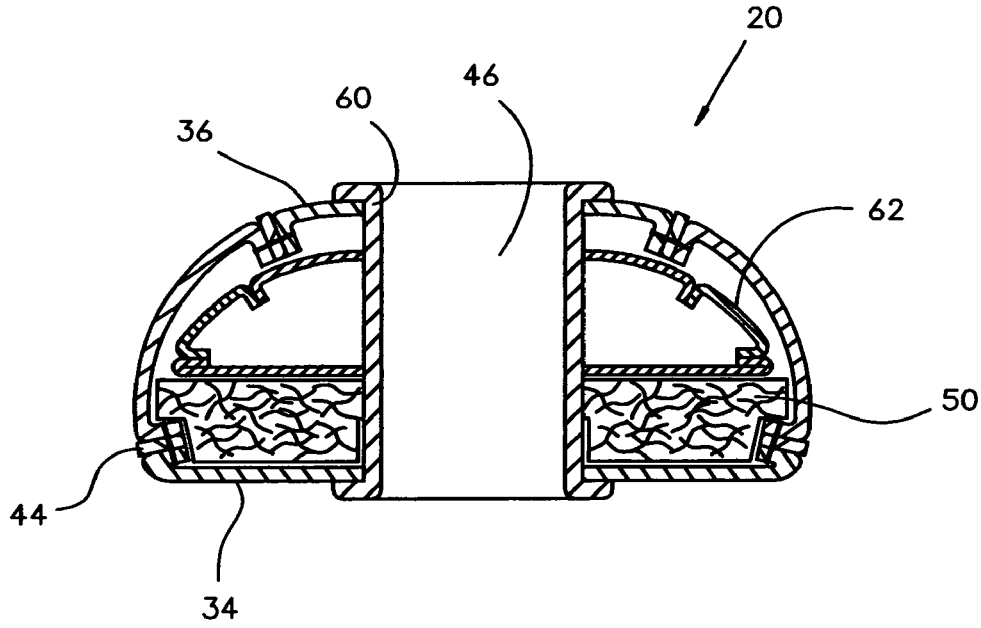
FIG. 11 is a transverse cross-sectional view of a finger stall a ball glove in accordance with another alternative preferred embodiment of the present invention.

In FIG. 10, the padding 50 generally fills the distal region 38 of the finger stall 20. Referring to FIG. 11, in another alternative embodiment, the padding 50 can extend along only the front portion 34 of the finger stall 20 with the finger lining 62 of the finger stall 20 extending beyond the length of the user's finger and along substantially the entire length of the finger stall 20. FIG. 11 demonstrates that the finger and/or thumb stall 20–28 remains an elongate cavity through a majority or substantially all of its length. The elongate cavity is an extension of the same cavity used to receive the player's finger or thumb. In the embodiment of FIG. 10, the padding 50 fills the elongate cavity at the distal portion 38 of the finger stall 20.

Figure 12:
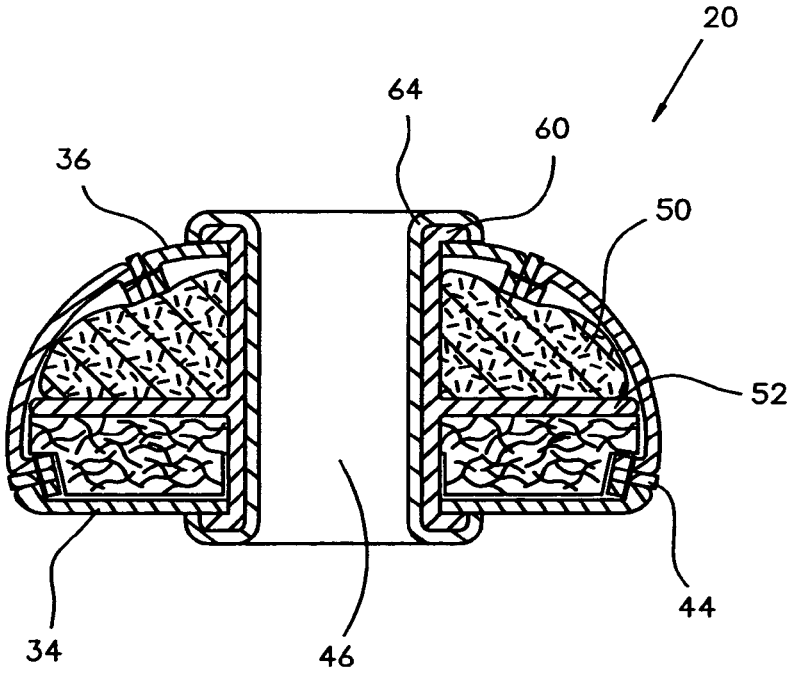
FIG. 12 is a transverse cross-sectional view of a finger stall a ball glove in accordance with another alternative preferred embodiment of the present invention.

Referring to FIG. 12, another alternative embodiment of the finger stall having a through-stall opening is shown. The finger stall 20 can also include an insert cover layer 64 extending over at least a portion of the exposed surfaces of the stall insert 60. Preferably, the insert cover layer 64 substantially covers all of the exposed surfaces of the stall insert 60. The insert cover layer 64 is preferably formed of a material that is different than the material of the stall insert 60, such as, for example, a leather. Alternatively, the insert cover layer 64 can be formed of other materials, such as, for example, a synthetic leather, a textile, a plastic, a composite material, a rubber, other polymeric materials, and combinations thereof. In one particularly preferred embodiment, the stall insert 60 is made of a relatively stiff material such as a plastic or a composite and the insert cover layer 64 is formed of a leather, thereby maintaining leather on the outer surfaces of the finger stall. Alternatively, the stall insert and the insert cover layer can be formed of the same material. The insert cover layer 64 can be formed of one or more colors or textures, which can match or differ from the color and texture of the front and back stall portions 34 and 36.

Figure 13:
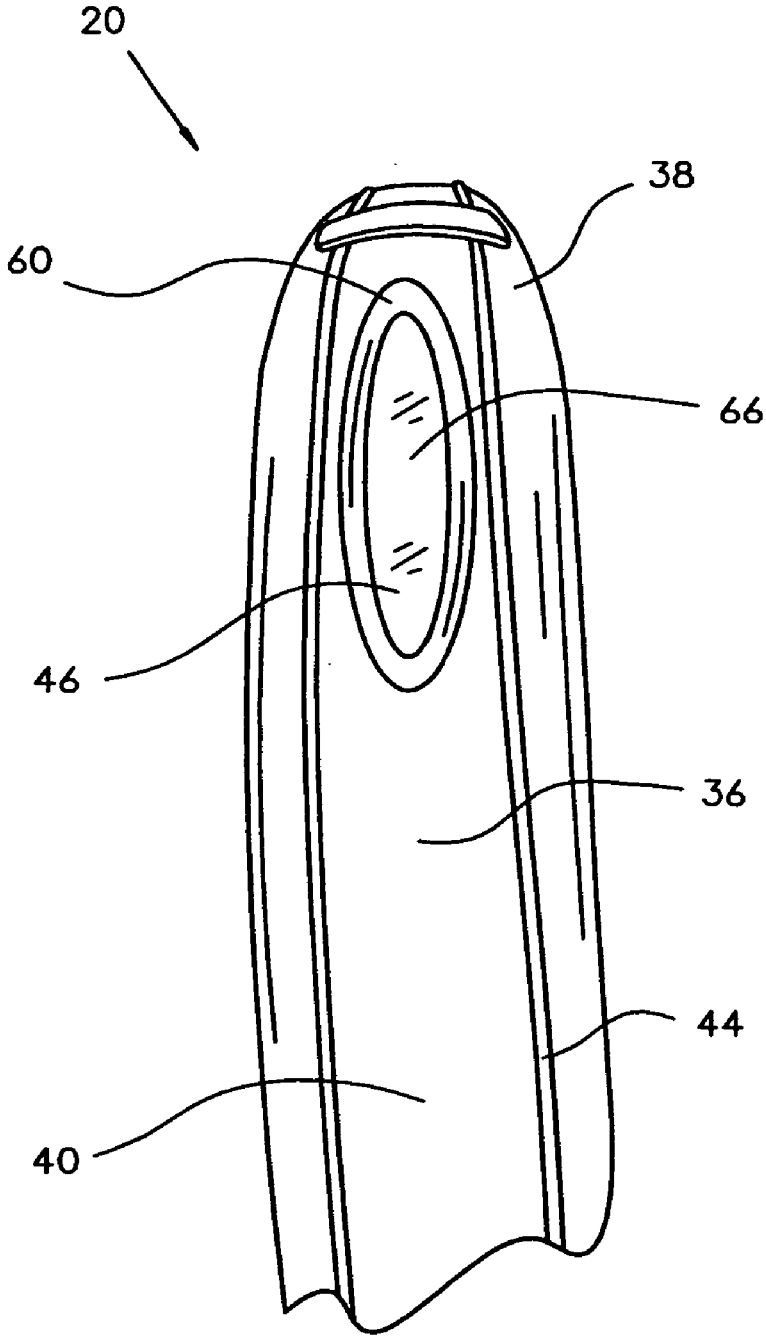
FIG. 13 is a rear view of a finger stall of a ball glove in accordance with another alternative preferred embodiment of the present invention.
Figure 14:
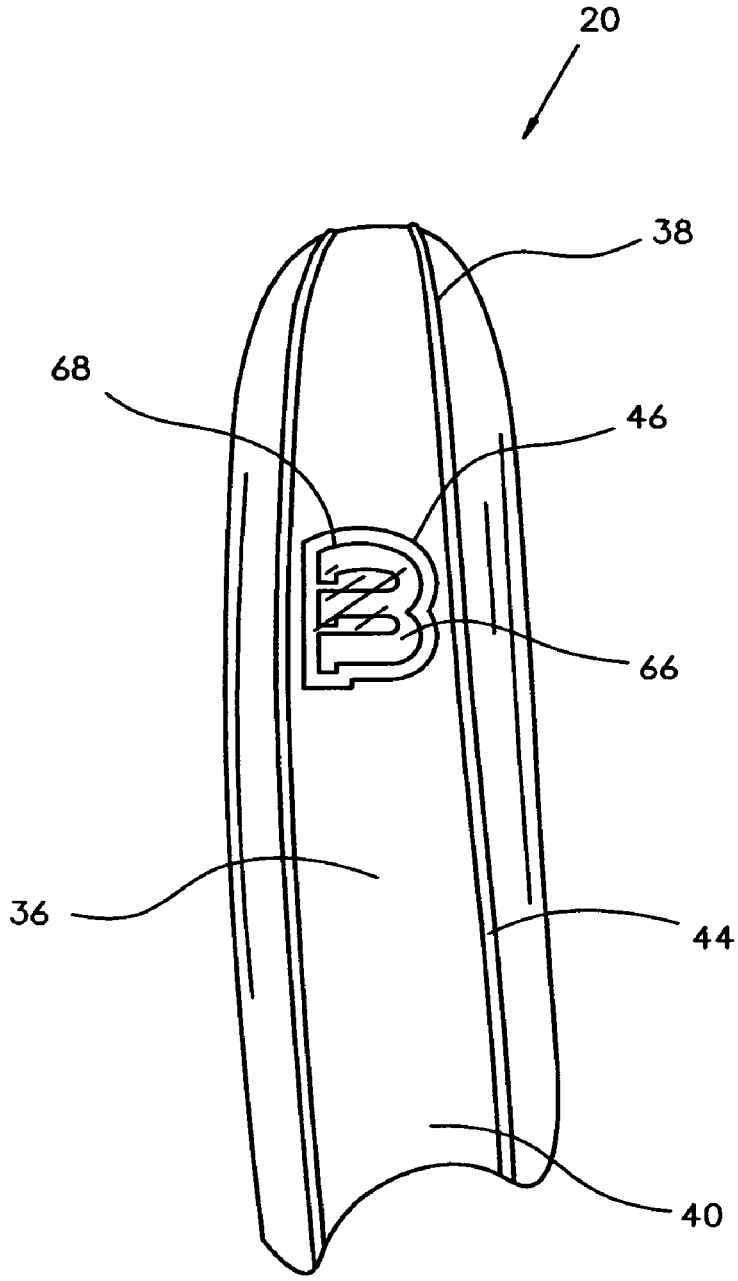
FIG. 14 is a rear view of a finger stall of a ball glove in accordance with another alternative preferred embodiment of the present invention.

Referring to FIGS. 13 and 14, in an alternative preferred embodiment of the present invention, a covering 66 can be positioned within or over the through-stall opening 46. The covering 66 is a generally planar or slightly curved element shaped to correspond to the size and/or contour of the through-stall opening 46. Accordingly, the covering 66 can take on any shape corresponding to the through-stall opening 46. Alternatively, the covering can have a shape that is different from the shape of the through-stall opening. The covering 66 can be fixedly or removably secured to the opening edges 54 defining the through-stall opening 46. Alternatively, one or more coverings 66 can be fixedly or removably secured to a single binding 56, a stall insert 60, or an insert cover layer 64. Preferably, when fixedly secured, the covering 66 is coupled to the front and back stall portions 34 and 36 through the use of an adhesive in combination with a snap-fit connection. The edges of the tapered region 20 can include a ridge or equivalent structure for facilitating the snap-fit connection of the covering 66 to the finger stall 20. In alternative preferred embodiments, the covering 66 can be secured to the finger stall 20 through other conventional means, such as, for example, thermal bonding or fasteners.

The covering 66 is formed of a lightweight durable material, preferably a thermoplastic material. Alternatively, the covering can be formed of other materials, such as, for example, other plastics, other polymeric materials, tempered glass, ceramics, a composite material or combinations thereof. Preferably, the covering 46 can also be formed of a material that is transparent, translucent, semi-transparent or semi-translucent, thereby enabling light to pass into and through the finger stall 20. The coverings 66 also can include alphanumeric indicia, designs, logos, trademarks, decals, symbols, product instructions, and/or other types of markings. The covering 66 can be formed of one or more colors or textures, which can match or differ from the color and texture of the front and back stall portions 34 and 36.

FIG. 13 illustrates another preferred embodiment of the present invention wherein the through-stall opening 46 has an oval shape and a corresponding oval shaped covering 66 is coupled to the finger stall 20 at the through-stall opening 46. In FIG. 14, the through-stall opening 46 is shaped to correspond to a trademark (for example, the W® of Wilson Sporting Goods Co.), and the covering 66 is shaped to match the shape of the through-stall opening 46. The covering 66 also includes indicia 68 representing the trademark W® of Wilson Sporting Goods Co.

Figure 15:
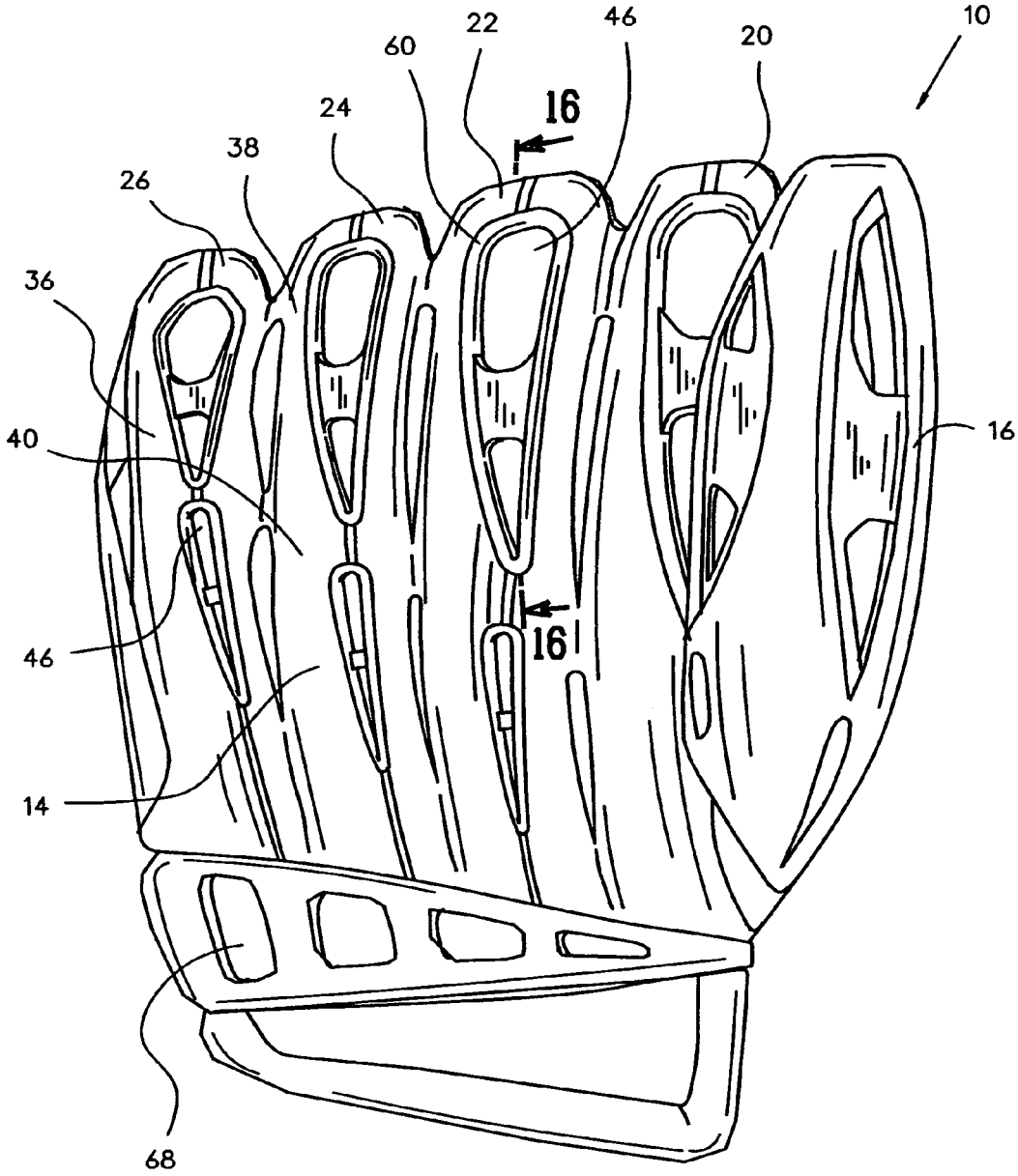
FIG. 15 is a rear view of a ball glove in accordance with another alternative preferred embodiment of the present invention.
Figure 16:
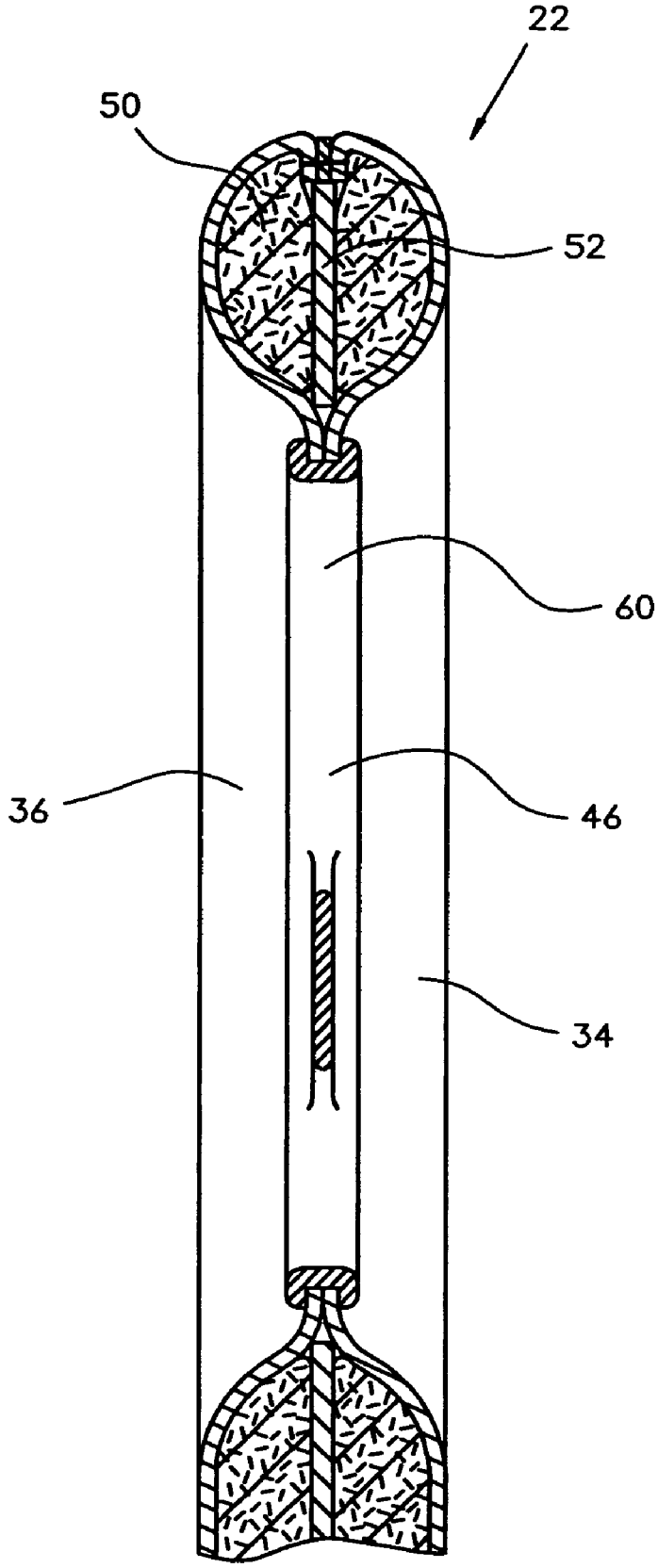
FIG. 16 is a cross-sectional view of the finger stall taken along line 16—16 of FIG. 15.

Referring to FIGS. 15 and 16, an alternative embodiment of a ball glove in accordance with the present invention is illustrated. In this embodiment, each of the finger stalls 20–26 include a plurality of openings 46 of different shapes. The openings 46 are defined at various positions along the entire finger stalls. Additionally, a plurality of body openings 68 is also defined into the back portion 14 of the ball glove 10. The openings 46 form an aesthetically pleasing pattern. The pattern can be further continued or extended by the body openings 68 and through openings formed within the webbing of the ball glove 10. The pattern of openings in FIG. 15 is one example of a pattern of openings through the finger stalls and through a portion of other locations of the ball glove to produce a unique, appealing appearance. In other alternative embodiments, other patterns can be formed by one or more openings defined into the finger stalls and/or back portion of the ball glove.

The openings 46 of FIGS. 15–16 are primarily formed through the use of stall inserts 60. The stall insert 60 define at least one through-wall opening 46 through the finger stalls 20–26. In one preferred embodiment as shown in FIG. 16, the stall insert 60 defines a pair of openings 46.

Figure 17:
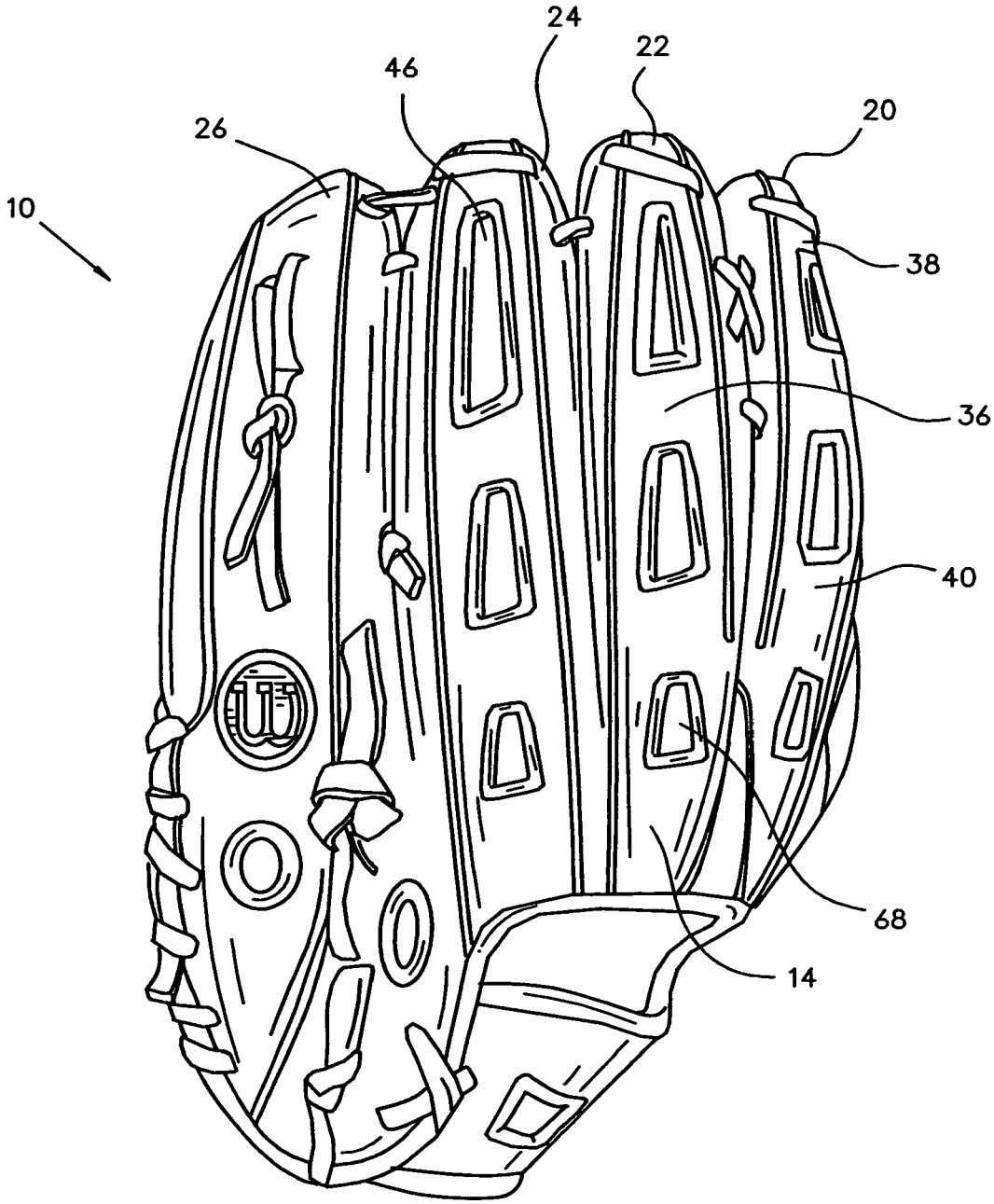
FIG. 17 is a rear side view of a ball glove in accordance with another alternative preferred embodiment of the present invention.

Referring to FIG. 17, another alternative embodiment of the present invention is illustrated. In this embodiment, through-stall openings extend along the finger stalls 20–26 and body openings 68 are formed into the back portion 14 near the proximal region 40 of the ball glove 10. FIG. 17 illustrates another example of a pattern formed by stall openings and the body openings. Other patterns are also contemplated under the present invention.

Figure 18:
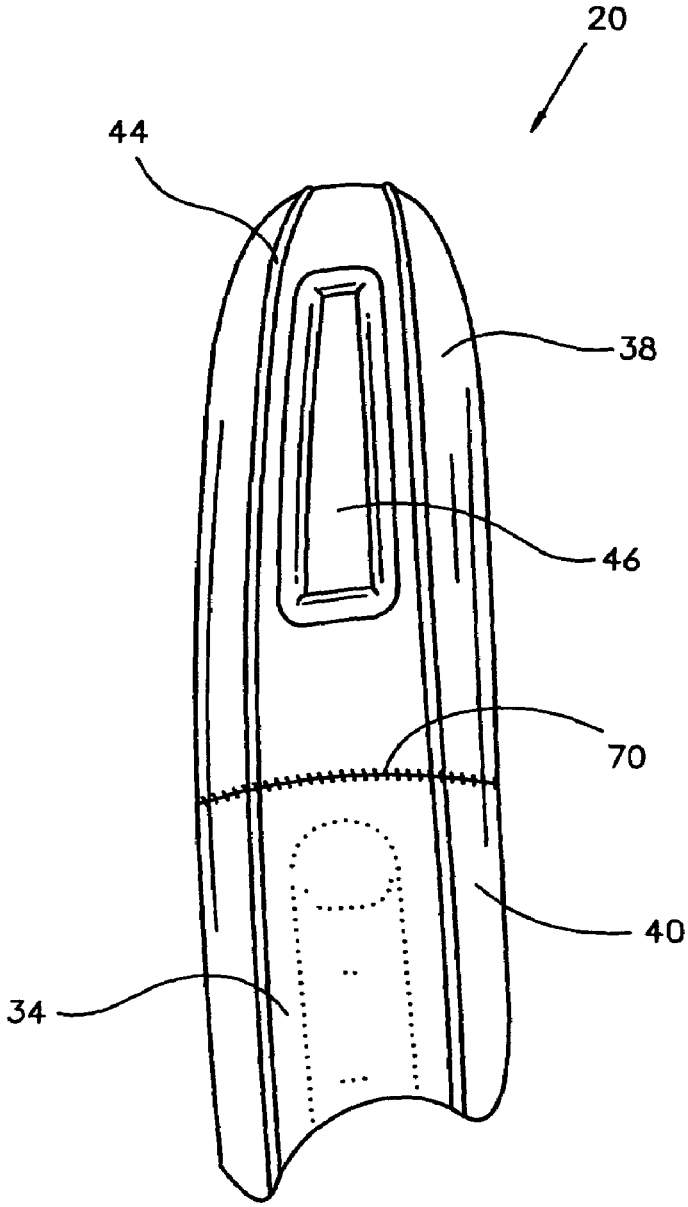
FIG. 18 is a rear view of a finger stall of a ball glove in accordance with another alternative preferred embodiment of the present invention.

Referring to FIG. 18, another alternative embodiment of the present invention is illustrated. The distal region 38 of the finger stall 20 can be formed separately from the proximal region 40 of the finger stall, and the two regions 38 and 40 can be coupled together to form the finger stall. In such an embodiment, one or more of the distal regions 38 of the finger stalls 20–28 can be manufactured separately from the remaining portions of the ball glove 10 and through different manufacturing processes. For example, the distal region(s) of one or more of the finger stalls may formed through molding (injection, blow, etc.) with the through-stall openings 46 pre-formed into the distal regions, while the proximal regions and other portions of the ball glove 10 can continue to be produced in a conventional fashion. Further, the distal regaion 38 of one or more of the finger and thumb stalls 20–28 may be manufactured from a different material or materials than the remaining portions of the ball glove 10. For example, the distal region can be made of lighter weight materials than the material or materials used to form the remaining portions of the ball glove. The separate regions can then be coupled together at coupling region 70 through the use of stitching, lacing, adhesives, bonding, fasteners or other conventional means. In this alternative preferred embodiment, the user's hand and finger maintain contact with the ball glove 10 in the same fashion as a conventional ball glove, and the outer region of the ball glove (not contacted by the user's hand during use) is formed separately and coupled to the ball glove.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A ball glove configured for catching a ball, the ball glove comprising:

a front glove portion;

a back glove portion coupled to the front glove portion to define a hand cavity and to form first, second, third and fourth finger stalls and a thumb stall;

at least one through-stall opening formed into at least one of the finger stalls, the through-stall opening having a size of at least 0.25 square inches; and a webbing coupled to, and positioned only between, the first finger stall and the thumb stall, the webbing configured to facilitate the catching of the ball.

2. The ball glove of claim 1, wherein each finger and thumb stall includes a distal region and a proximal region, and wherein the at least one through-stall opening is formed into the distal region of finger or thumb stall.

3. The ball glove of claim 1, wherein each through-stall opening has a size of at least 0.5 $in^2$.

4. The ball glove of claim 1, wherein each through-stall opening has a size of at least 1 $in^2$.

5. The ball glove of claim 1, wherein the through-stall opening is formed into a shape selected from the group consisting of a trademark, a symbol, alphanumeric indicia, and combinations thereof.

6. The ball glove of claim 1, wherein the through-stall opening is formed into a shape selected from the group consisting of a circle, an oval, a square, a triangle, other polygonal shapes, other closed curved shapes and irregular closed shapes.

7. The ball glove of claim 1, wherein the at least one finger stall includes at least one stitched edging defining the general shape of the through-stall opening.

8. The ball glove of claim 7 further comprising at least one binding extending over at least a portion of the edging.

9. A ball glove comprising:

a front glove portion;

a back glove portion coupled to the front glove portion to define a hand cavity and to form first, second, third and fourth finger stalls and a thumb stall;

at least one through-stall opening formed into at least one of the finger stalls, the through-stall opening having a size of at least 0.25 square inches;

a webbing coupled to, and positioned between, the first finger stall and the thumb stall; and a stall insert coupled to the at least one finger stall to define, at least in part, the shape of the at least one opening.

10. The ball glove of claim 9, wherein the finger stall is formed of front and back stall portions, and wherein the stall insert contributes to spacing apart the front and back stall portions by a distance within the range of 0.25 to 2.0 inches.

11. The ball glove of claim 9, wherein the stall insert is formed of a material selected from the group consisting of a leather, a synthetic leather, a plastic, a composite material, a polymer, wood, aluminum and combinations thereof.

12. A ball glove comprising:

a front glove portion;

a back glove portion coupled to the front glove portion to define a hand cavity and to form first, second, third and fourth finger stalls and a thumb stall;

at least one through-stall opening formed into at least one of the finger stalls, the through-stall opening having a size of at least 0.25 square inches;

a webbing coupled to, and positioned between, the first finger stall and the thumb stall; and at least one covering being positioned in or over the opening.

13. The ball glove of claim 12, wherein the covering is formed of a material selected from the group consisting of a translucent material, a semi-translucent material, a transparent material, a semi-transparent material, and combinations thereof.

14. The ball glove of claim 12, wherein the at least one covering is fixedly coupled to the distal region of the finger stall.

15. The ball glove of claim 12, wherein the at least one covering is removably coupled to the distal region of the finger stall.

16. The ball glove of claim 12, wherein the at least one covering is formed of a material selected from the group consisting of a plastic, a polyurethane, and other polymeric material.

17. The ball glove of claim 12, wherein the at least one covering further includes at least one marking selected from the group consisting of a trademark, a symbol, alphanumeric indicia, and combinations thereof.

18. A ball glove comprising:

a front glove portion;

a back glove portion coupled to the front glove portion to define a hand cavity and to form first, second, third and fourth finger stalls and a thumb stall;

at least one through-stall opening formed into at least one of the finger stalls, the through-stall opening having a size of at least 0.25 square inches;

a webbing coupled to, and positioned between, the first finger stall and the thumb stall; and each finger and thumb stall including a distal region and a proximal region, the at least one through-stall opening being formed into the distal region of finger or thumb stall, the distal region of at least one of the finger stalls being formed separately from the proximal region of the finger stall, and the distal region being coupled to the proximal region.

19. The ball glove of claim 18, wherein the distal region of the at least one of the finger stalls is formed of a first material or a first group of materials, and the proximal region of the at least one of the finger stalls is formed of a second material or second group of materials, and wherein the first material or first group of materials is different than the second material or second group of materials.

20. A ball glove for use by a ball player in catching a ball, the glove comprising:

a front glove portion;

a back glove portion coupled to the front glove portion to define a hand cavity and to form first, second, third and fourth finger stalls and a thumb stall, each finger stall including a distal region and a proximal region;

at least one through-stall opening formed into at least one of the finger stalls, the through-stall opening sufficiently sized to enable the ball player to see the ball through the opening; and a webbing coupled to, and positioned between, the first finger stall and the thumb stall.

21. The ball glove of claim 20, wherein at least three of the first, second, third and fourth finger stalls each include at least at least one of the through-stall openings, and wherein the through-stall openings form a pattern.

22. The ball glove of claim 21, further comprising at least one body opening defined into at least one of the front portion and the back portion of the ball glove.

23. The ball glove of claim 22, wherein the at least one through-stall opening and the at least one body opening combine to form the pattern.

24. The ball glove of claim 20, wherein each through-stall opening has a size of at least 0.5 $in^2$.

25. The ball glove of claim 20, wherein each through-stall opening has a size of at least 1 $in^2$.

26. The ball glove of claim 20, wherein the through-stall opening is formed into a shape selected from the group consisting of a trademark, a symbol, alphanumeric indicia, and combinations thereof.

27. The ball glove of claim 20, wherein the through-stall opening is formed into a shape selected from the group consisting of a circle, an oval, a square, a triangle, other polygonal shapes, other closed curved shapes and irregular closed shapes.

28. The ball glove of claim 20, wherein the at least one finger stall includes at least one stitched edging defining the general shape of the through-stall opening.

29. The ball glove of claim 20, further comprising a frame element coupled to the at least one finger stall to define, at least in part, the shape of the at least one opening.

30. The ball glove of claim 29, wherein the frame element is formed of a material selected from the group consisting of a leather, a synthetic leather, a plastic, a composite material, a polymer, wood, aluminum and combinations thereof.

31. The ball glove of claim 20, further including at least one covering positioned in or over the opening.

32. The ball glove of claim 31, wherein the covering is formed of a material selected from the group consisting of a translucent material, a semi-translucent material, a transparent material, a semi-transparent material, and combinations thereof.

33. The ball glove of claim 31, wherein the at least one covering further includes at least one marking selected from the group consisting of a trademark, a symbol, alphanumeric indicia, and combinations thereof.

34. The ball glove of claim 20, further comprising a stall insert coupled to the at least one finger stall to define, at least in part, the shape of the at least one opening.

35. The ball glove of claim 34, wherein the finger stall is formed of front and back stall portions, and wherein the stall insert contributes to spacing apart the front and back stall portions by a distance within the range of 0.25 to 2.0 inches.

36. A ball glove comprising:

a front glove portion;

a back glove portion coupled to the front glove portion to define a hand cavity and to form first, second, third and fourth finger stalls and a thumb stall, each of the finger stalls and thumb stall defining an elongate opening;

at least one through-stall opening formed into at least one of the finger stalls, at least one of the through-stall opening being un-laced; and a webbing coupled to, and positioned between, the first finger stall and the thumb stall.

37. The ball glove of claim 36, wherein all of the through-stall openings are un-laced.

38. The ball glove of claim 36, wherein each finger and thumb stall includes a distal region and a proximal region, and wherein the at least one through-stall opening is formed into the distal region of finger or thumb stall.

39. The ball glove of claim 36, wherein each through-stall opening has a size of at least 0.25 $in^2$.

40. The ball glove of claim 36, wherein each through-stall opening has a size of at least 0.5 $in^2$.

41. The ball glove of claim 36, wherein each through-stall opening has a size of at least 1 $in^2$.

42. The ball glove of claim 36, wherein the through-stall opening is formed into a shape selected from the group consisting of a trademark, a symbol, alphanumeric indicia, and combinations thereof.

43. The ball glove of claim 36, wherein the through-stall opening is formed into a shape selected from the group consisting of a circle, an oval, a square, a triangle, other polygonal shapes, other closed curved shapes and irregular closed shapes.

44. The ball glove of claim 36, wherein the at least one finger stall includes at least one stitched edging defining the general shape of the through-stall opening.

45. The ball glove of claim 44 further comprising at least one binding extending over at least a portion of the edging.

46. The ball glove of claim 36, wherein the at least one through-stall opening is two or more through-stall openings, and wherein the combined area defined by the through-stall openings is at least 0.25 $in^2$.

47. The ball glove of claim 36, further comprising a stall insert coupled to the at least one finger stall to define, at least in part, the shape of the at least one opening.

48. The ball glove of claim 36, further including at least one covering positioned in or over the opening.

49. The ball glove of claim 48, wherein the covering is formed of a material selected from the group consisting of a translucent material, a semi-translucent material, a transparent material, a semi-transparent material, and combinations thereof.

50. The ball glove of claim 48, wherein the at least one covering is fixedly coupled to the distal region of the finger stall.

51. The ball glove of claim 48, wherein the at least one covering is removably coupled to the distal region of the finger stall.

52. The ball glove of claim 48, wherein the at least one covering further includes at least one marking selected from the group consisting of a trademark, a symbol, alphanumeric indicia, and combinations thereof.

53. The ball glove of claim 9, wherein each finger and thumb stall includes a distal region and a proximal region, and wherein the at least one through-stall opening is formed into the distal region of finger or thumb stall.

54. The ball glove of claim 9, wherein each through-stall opening has a size of at least 0.5 $in^2$.

55. The ball glove of claim 9, wherein each through-stall opening has a size of at least 1 $in^2$.

56. The ball glove of claim 9, wherein the through-stall opening is formed into a shape selected from the group consisting of a trademark, a symbol, alphanumeric indicia, and combinations thereof.

57. The ball glove of claim 9, wherein the through-stall opening is formed into a shape selected from the group consisting of a circle, an oval, a square, a triangle, other polygonal shapes, other closed curved shapes and irregular closed shapes.

58. The ball glove of claim 12, wherein each through-stall opening has a size of at least 0.5 $in^2$.

59. The ball glove of claim 12, wherein each through-stall opening has a size of at least 1 $in^2$.

60. The ball glove of claim 12, wherein the through-stall opening is formed into a shape selected from the group consisting of a trademark, a symbol, alphanumeric indicia, and combinations thereof.

61. The ball glove of claim 12, wherein the through-stall opening is formed into a shape selected from the group consisting of a circle, an oval, a square, a triangle, other polygonal shapes, other closed curved shapes and irregular closed shapes.

62. The ball glove of claim 18, wherein each through-stall opening has a size of at least 0.5 $in^2$.

63. The ball glove of claim 18, wherein each through-stall opening has a size of at least 1 $in^2$.

64. The ball glove of claim 18, wherein the through-stall opening is formed into a shape selected from the group consisting of a trademark, a symbol, alphanumeric indicia, and combinations thereof.

65. The ball glove of claim 18, wherein the through-stall opening is formed into a shape selected from the group consisting of a circle, an oval, a square, a triangle, other polygonal shapes, other closed curved shapes and irregular closed shapes.

* * * * *